United States Patent [19]

Dekkers et al.

[11] 4,429,201

[45] Jan. 31, 1984

[54] ELECTRICAL SWITCH HAVING A RECIPROCATING WIPING ACTUATOR

[75] Inventors: Leo P. Dekkers, Scituate; James R. Spencer, Woburn, both of Mass.

[73] Assignee: Midland-Ross Corporation, Cleveland, Ohio

[21] Appl. No.: 348,659

[22] Filed: Feb. 12, 1982

[51] Int. Cl.[3] ..... H01H 1/00

[52] U.S. Cl. ..... 200/159 A; 200/153 M; 200/284

[58] Field of Search ..... 200/239, 153 M, 159 A, 200/283, 284

[56] References Cited

U.S. PATENT DOCUMENTS

| | | | |
|---|---|---|---|
| 1,575,469 | 3/1926 | Waterbury | 200/153 M |
| 3,400,234 | 9/1968 | Long | 200/284 X |
| 3,697,706 | 10/1972 | Huggard | 200/153 M X |
| 3,873,795 | 3/1975 | Leighton et al. | 200/159 A X |
| 3,924,090 | 12/1975 | Chao et al. | 200/153 M X |
| 3,944,760 | 3/1976 | Zdanys et al. | 200/153 M X |
| 4,224,488 | 9/1980 | Rossi | 200/261 X |

*Primary Examiner*—John W. Shepperd
*Assistant Examiner*—Renee S. Kidorf
*Attorney, Agent, or Firm*—H. Duane Switzer

[57] ABSTRACT

A switch including a housing in which a pair of electrical contacts are positioned for movement between open and closed positions. An actuator movably mounted in the housing moves between contacts open and contacts closed positions. The actuator includes a wiper wall movable between and across the contacts for opening same and wiping same upon movement of the actuator to its contacts open position. The entire switch is assembled without the use of mechanical fasteners or bonding of any kind.

13 Claims, 10 Drawing Figures

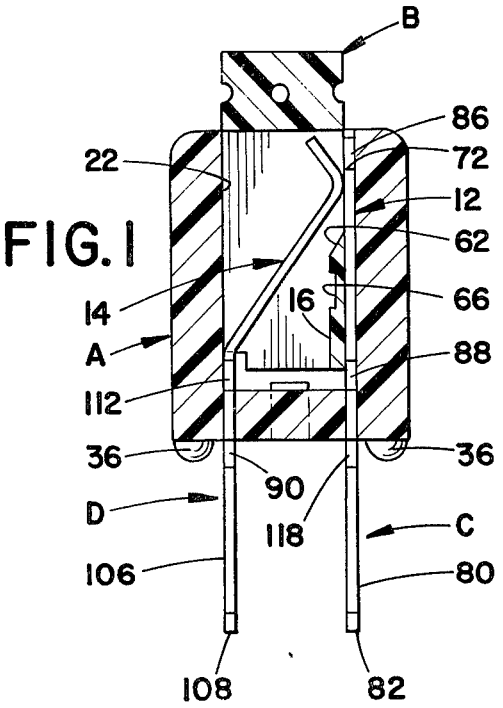
FIG. 1
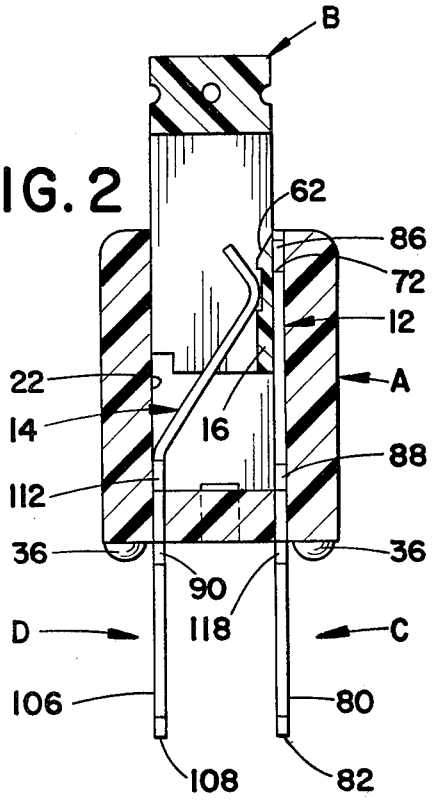
FIG. 2
FIG. 5
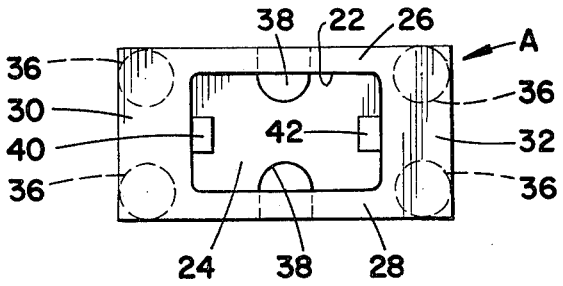
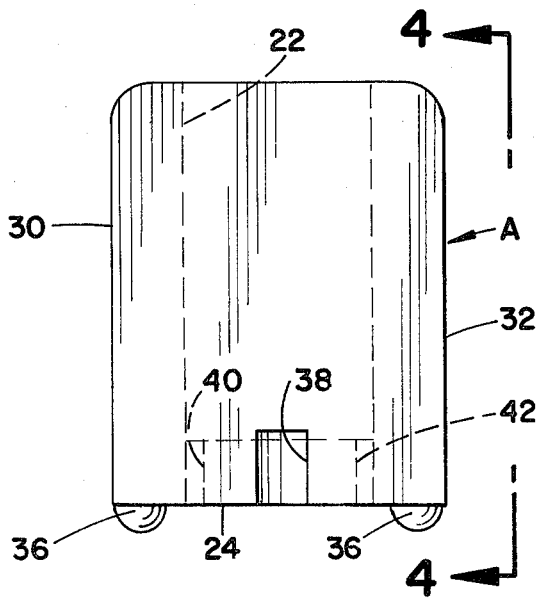
FIG. 3
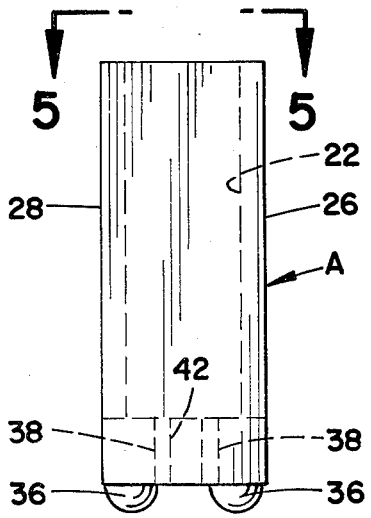
FIG. 4

ELECTRICAL SWITCH HAVING A RECIPROCATING WIPING ACTUATOR

BACKGROUND OF THE INVENTION

This application relates to the art of switches and, more particularly, to miniature switches.

Small switches used with printed circuit boards or the like are very difficult to assemble because the various tiny parts are difficult to handle. The performance of such switches also deteriorates due to deposits on the contacts.

It would be desirable to have a miniature switch which was very simple to assemble and very reliable in operation.

SUMMARY OF THE INVENTION

A miniature switch includes a housing in which a pair of electrical contacts are positioned for movement between open and closed positions. An actuator movably mounted in the housing for so moving the contacts is movable between contacts open and contacts closed positions, and includes a wiper wall movable across the contacts for wiping same every time the contacts are made or broken to remove deposits or oxide coating so that good electrical conductivity is maintained.

The switch housing has a cavity defined within a housing peripheral wall and a housing bottom wall. A fixed lead extends along a surface of the peripheral wall within the cavity and a flexible lead is positioned in the cavity in opposed relationship to the fixed lead. Cooperable electrical contacts are provided on the leads, and the flexible lead is under bending stress to normally engage the contacts. The actuator reciprocates within the cavity for making and breaking the contacts.

Each lead extends through a hole in the housing bottom wall and each lead has lateral enlargements thereon, on opposite sides of the housing bottom wall. Each enlargement has a lateral dimension greater than the maximum lateral dimension of a hole so that the leads are held against separation from the housing by cooperation between the housing bottom wall and the lateral enlargements.

Cooperating means is provided between the fixed lead and the actuator for preventing separation is of the actuator from the housing once all of the components are assembled. This cooperating means may take the form of a lateral projection on the fixed lead cooperating with an abutment on the actuator when the actuator is moved in a direction tending to displace same from the open end of the housing cavity.

It is a principal object of the present invention to provide a highly reliable miniature switch.

It is also an object of the invention to provide such a switch which is very easy to assemble without requiring the use of any mechanical fasteners or bonding procedures.

It is an additional object of the invention to provide such a switch wherein the contacts are wiped every time they are made and broken.

BRIEF DESCRIPTION OF THE DRAWING

FIG. 1 is a front elevational view of a switch constructed in accordance with the present application with a side wall of the switch housing being removed to show the internal parts, and with the contacts and actuator in a closed position;

FIG. 2 is a view similar to FIG. 1, and showing the contacts and actuator in an open position;

FIG. 3 is a front elevational view of the switch housing;

FIG. 4 is an end elevational view taken generally on line 4—4 of FIG. 3;

FIG. 5 is a top plan view taken generally on line 5—5 of FIG. 4;

DESCRIPTION OF A PREFERRED EMBODIMENT

Figure 6:
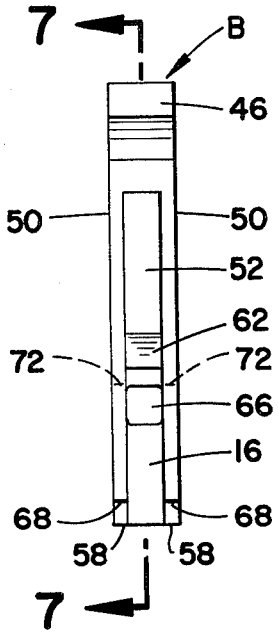
FIG. 6 is an end elevational view of the switch actuator.

With reference to the drawing, wherein the showings are for purposes of illustrating a preferred embodiment of the invention only and not for purposes of limiting same, FIGS. 1 and 2 show a switch as including a housing A having a cavity 22 in which an actuator B is received for reciprocation between the contacts closed and contacts open positions respectively shown in FIGS. 1 and 2. A pair of elongated metal contacts leads C,D, extend through a housing bottom wall, and respectively have an inner fixed lead portion 12 and an inner movable lead portion 14 received in the housing cavity. Flexible lead portion 14 is in opposed relationship to fixed lead portion 12 and is under bending stress for normally engaging fixed lead portion 12. Actuator B includes a wiper wall 16 which moves between and across the contact areas of lead portions 12,14 upon movement of actuator B to its contacts open position of FIG. 2. Thus, the contact areas of lead portions 12,14 are wiped by opposite surfaces of wiper wall 16 every time actuator B moves between its contacts open and contacts closed positions.

The various individual components of the switch will be described in great detail, and reference may then be made to FIGS. 1 and 2 to see how the components fit together and cooperate.

FIGS. 3-5 show switch housing A in the form of a generally rectangular solid having an elongated generally rectangular cavity 22 therein. Housing A is preferably molded of any suitable synthetic plastic material, such as a high temperature glass filled polyester. Cavity 22 is open at one end and is substantially closed at its other end by a housing bottom wall 24. A housing peripheral wall surrounding cavity 22 includes parallel opposite side walls 26,28 and parallel opposite end walls 30,32 which are substantially thicker than the side walls 26,28.

A rounded boss 36 projects outwardly from housing bottom 24 adjacent each corner thereof for spacing bottom wall 24 of housing A above the surface of an integrated circuit board or the like to which the switch is mounted. Bosses 36 serve as anti-moisture bosses to prevent moisture from wicking up into cavity 22. A pair of arcuate drain holes 38 extend through housing bottom wall 24 adjacent side walls 26,28 approximately midway between end walls 30, 32. Housing A or the entire switch assembly may be washed after manufacture to remove all contamination therefrom and drain holes 38 allow all washing liquid to drain from cavity 22.

A pair of rectangular holes 40,42 extend through housing bottom wall 24 adjacent end walls 30,32 and approximately midway between side walls 26,28. Rectangular holes 40,42 have a constant rectangular cross-sectional size and shape throughout their entire length and one surface of each hole is flush with the inner flat surface of an end wall 30,32.

Figure 7:
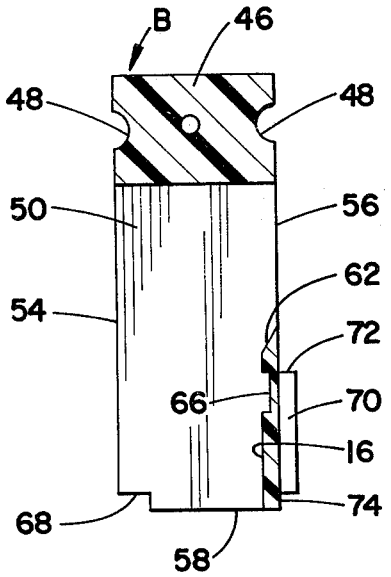
FIG. 7 is a cross-sectional elevational view taken generally on line 7—7 of FIG. 6.

FIGS. 6 and 7 show actuator B as having an actuator head 46 with opposite laterally opening gripper grooves 48 therein. Although head 46 is shown as being approximately the same peripheral size as the remainder of the actuator, it will be recognized that head 46 can be made substantially larger, such as of the same peripheral size as housing A. Gripper grooves 48 receive a person's fingernails or some other device for pulling on actuator B. Obviously, many other arrangements may be provided for gripping actuator B. A pair of spaced-apart parallel flat actuator side walls 50 extend downwardly from head 46 to provide a space 52 therebetween which also defines a lateral passage completely through actuator B. Side walls 50 have rear edges 54, front edges 56 and bottom edges 58. An integral wiper wall 16 connects side walls 50 adjacent front edges 56 thereof. Wiper wall 16 extends upwardly from bottom edge 58 and terminates at a sloping upper surface 62 which makes an angle of approximately 30° with the vertical as shown in FIG. 7. Sloping upper surface 62 on wiper wall 16 terminates approximately midway between actuator side wall bottom edges 58 and the underside of actuator head 46. A generally rectangular recess or detent 66 extends inwardly into wiper wall 16 at a location spaced a short distance below upper sloping surface 62 thereof to provide a positive stop for a switch contact.

The corner intersections between actuator rear edges 54 and bottom edges 58 are removed to provide generally rectangular notches 68. A pair of spaced apart flanges 70 extend outwardly from wiper wall 16 and have their outer surfaces substantially flush with the outer surfaces of actuator side walls 50. Flanges 70 provide upwardly facing abutment edges 72 for a purpose to be described. The bottom edges of flanges 70 are spaced above actuator side wall bottom edges 58 to provide notches generally indicated at 74.

Figure 8:
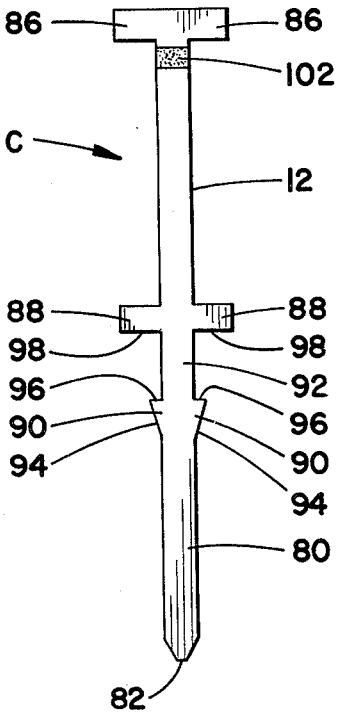
FIG. 8 is an elevational view of a fixed lead.

FIG. 8 shows an elongated metal fixed lead C. Although the leads used in the switch of the present application may be made with any suitable material, it has been found that heat treated beryllium-copper, coated with copper flash for corrosion protection, are very suitable. Fixed lead C has an outer connecting portion 80 which terminates at a relatively sharp point 82. An inner fixed lead portion 12 terminates at its upper end in a pair of lateral projections 86. Thus, the upper portion of inner lead portion 12 is generally T-shaped as shown in FIG. 8. Another pair of lateral projections 88, similar to projections 86, are located approximately midway between the opposite ends of fixed lead C. Another pair of smaller lateral projections 90 are spaced toward pointed end 82 from projections 88 along a lead mounting portion 92. Projections 88, 90 define lateral enlargements for holding fixed lead C to housing A. Enlargements 90 have tapering edges 94 which taper outwardly in a direction away from connecting lead portion 80 to provide a relatively sharp entrance end portion facing toward connecting lead portion 80. Tapering edges 94 terminate at blunt edges 96 which are directly opposed by blunt edges 98 on enlargements 88. The distance between blunt edges 96, 98 is just slightly greater than the thickness of bottom wall 24 on housing A. The cross-sectional size and shape of fixed lead C along portions 80,12 and 92 thereof is just slightly smaller than rectangular hole 42 in bottom wall 24 of housing A. The cross-sectional size and shape of fixed lead C at enlargements 88,90 is substantially greater than rectangular hole 42. Thus, it will be seen that connecting lead portion 80 may be extended through hole 42 and then forced through causing the sharp tapering edges of enlargements 90 to cut through the plastic material until blunt edges 96 are outside of housing A. The plastic material tends to close up after the enlargements cut therethrough. Therefore, there is no opening through which blunt edges 96 can pass in a reverse direction. Fixed lead C is positioned with projections 86,88 lying against the flat inner surface of end wall 32. A small strip of gold or the like may be plated on fixed inner lead portion 12 adjacent projections 86 to provide an electrical contact as generally indicated at 102 in FIG. 8.

Figure 10:
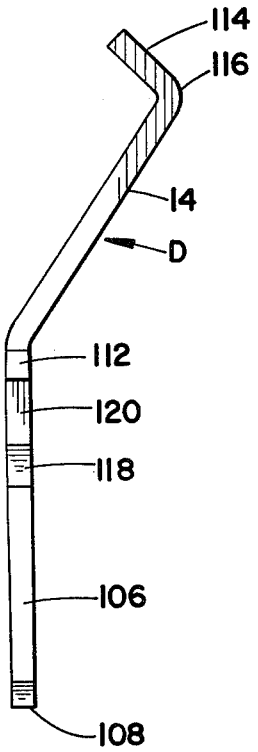
FIG. 10 is an end elevational view taken generally on line 10—10 of FIG. 9.
Figure 9:
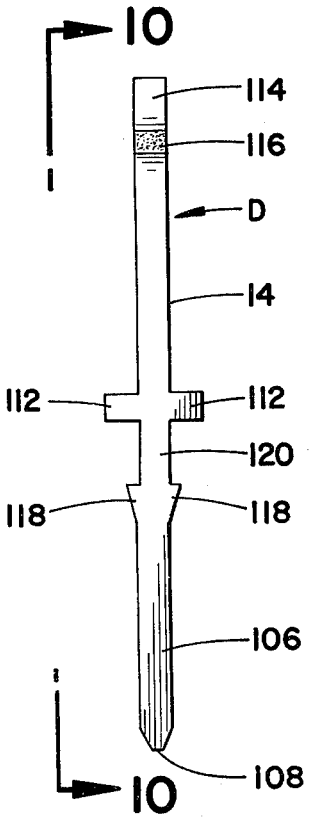
FIG. 9 is an elevational view of a flexible lead.

FIGS. 9 and 10 show flexible lead D as including an outer connecting portion 106 terminating at a relative sharp point 108. An inner flexible lead portion 14 is bent laterally just above the lateral enlargements defined by projections 112. The terminal end portion of flexible lead portion 14 is reversely bent as generally indicated at 114 to provide a rounded contact area 116 which is suitably plated with gold or the like. Lateral enlargements defined by projections 118 are separated from lateral enlargements 112 by mounting portion 120. Lateral enlargements 118 have the same size and shape as lateral enlargements 90 on fixed lead C. Likewise, the cross-sectional size and shape of flexible lead D along portions 106, 14 and 120 thereof is just slightly less than the size and shape of hole 40 in housing bottom wall 24. The opposed blunt edges of enlargements 112, 118 are spaced-apart from one another a distance slightly greater than the thickness of housing bottom wall 24.

Flexible lead D is securable to housing A by extending outer lead portion 106 through cavity 22 and through rectangular hole 40. Forcing connecting lead portion 106 through 42 then causes lateral enlargements 118 to cut through bottom wall 24 until enlargements 118 are located outside of bottom wall 24. Flexible lead D is s assembled with flexible lead portion 14 extending across cavity 22 from end wall 30 toward end wall 32.

In order to assemble the switch, fixed lead C is positioned with inner lead portion 12 thereof located between flanges 70 on actuator B and with lateral enlargements 88 received in notches 74. Flexible lead portion 14 of movable lead D is extended through passage 52 between actuator side walls 50 and with enlargements 112 received in notches 68. The assembled actuator and leads are then inserted in housing cavity 22 for extending outer lead portions 80, 106 through holes 42,40. Such outer lead portions, enlargements 90, 118 are forced through housing bottom wall 24. Once the enlargements are located on opposite sides of bottom wall 24, lateral enlargements 86 on fixed lead C are located adjacent the open upper end of cavity 22. Attempted outward displacement of actuator B from cavity 22 is prevented because upwardly facing abutment shoulders 72 on actuator flanges 70 will strike against the bottom edges of enlargements 86. Thus, the switch cannot be disassembled. Actuator flanges 70 are spaced-apart a distance for closely receiving fixed inner lead portion 12 therebetween. Notches 68,74 at the bottom corners of actuator B provide clearance for receiving lateral enlargements 88, 112 on leads C,D, when actuator B is in its lowermost position.

Flexible contact D is dimensioned so that flexible contact portion 14 is under bending stress and biased into engagement with inner contact portion 12 of fixed lead C so that contacts 102 and 116 engage one another. Upon upward movement of actuator B from the position shown in FIG. 1 to the position shown in FIG. 2, sloping upper surface 62 on wiper wall 16 will cam against contact area 116 and bend flexible contact portion 14 away from fixed contact C. At the same time, flat inner and outer surfaces of wiper wall 16 slide across contacts 102, 116 for wiping deposits therefrom to insure clean contacts every time the switch is operated. Detent 66 in wiper wall 16 receives contact area 116 on flexible contact portion 14 to provide a positive stop for holding actuator B in its contacts open position of FIG. 2. In addition, an audible indication is provided by snapping of contact area 116 into detent 66.

Actuator B is dimensioned for close sliding reception within cavity 22. Thus, the outer surfaces of actuator sidewalls 50 are spaced-apart a distance just slightly less than the spacing between the inner surfaces of housing side walls 26,28. Likewise, the spacing between actuator side wall edges 54,56 is just slightly less than the distance between the inner surfaces of housing end walls 30,32. When actuator B moves to its contacts open position, the spring force in flexible contact portion 14 biases actuator B and wiper wall 16 thereof toward fixed contact C. This insures firm engagement of the opposite flat surfaces on wiper wall 16 with contacts 102,116 for wiping same.

Although actuator B may be made of various materials, it is preferably molded in one piece of suitable synthetic plastic material. A polyamide has been advantageously used for actuator B because it has a low friction characteristic to provide good sliding movement and good wiping action across the contacts.

It is possible to manufacture and assemble the switch of the present application in a variety of sizes, including very small sizes. By way of example only and not by way of limitation, switch models have been made with housing cavity 22 having a length and width of approximately 0.116 inch and 0.073 inch, and a depth of approximately 0.200 inch. Holes 40,42 in housing bottom wall 24 were approximately 0.017 inch by 0.021 in cross-sectional size. Outer portions 80, 106 of leads C,D, are spaced-apart approximately 0.10 inch.

Although the invention has been shown and described with respect to a preferred embodiment, it is obvious that equivalent alterations and modifications will occur to others skilled in the art upon the reading and understanding of this specification. The present invention includes all such equivalent alterations and modifications, and is limited only by the scope of the claims.

We claim:

1. A miniature switch, comprising: a housing including a cavity defined by a peripheral wall and a bottom wall connected with the peripheral wall, said peripheral wall providing opposed side surfaces within said cavity, the cavity being open at one end and being closed by said bottom wall of said housing at a longitudinally opposed end, said cavity being surrounded by said peripheral wall of said housing extending between said ends of said cavity, the bottom wall being perforated by mounting holes;

a pair of elongate electrical leads mounted in and passing through the mounting holes and extending generally longitudinally from said bottom wall and toward said open end of said housing cavity, both of said leads having electrical contacts thereon, a first one of said leads being flexible between open and closed positions of said contacts; and an actuator movably mounted for longitudinal reciprocation relative to said bottom wall through said open end and along said housing cavity for flexing said first one of said contacts between said open and closed positions, said actuator including a wiper wall and a pair of side walls connected by said wiper wall, said wiper wall being movable between and across said contacts for opening and wiping said contacts upon movement of said actuator, said side walls being spaced-apart to permit sliding movement of said side walls against said opposed side surfaces during said reciprocation of said actuator.

2. The switch of claim 1 wherein said leads include a fixed lead and a flexible lead.

3. The switch of claim 2 wherein said flexible lead extends through said actuator.

4. The switch of claim 1 including cooperating means between said actuator and at least one of said leads for preventing separation of said actuator from said housing.

5. The switch of claim 1 wherein said leads include a fixed lead and a flexible lead normally yieldably biased toward said fixed lead, said actuator being reciprocatable between said contacts opened and contacts closed positions.

6. The switch of claim 1 wherein said wiper wall includes detent means for at least partly receiving one of said contacts in said contacts opened position of said actuator.

7. A miniature switch comprising:

a housing defining a cavity with an open end and having at least a pair of contact mounting holes extending therethrough;

a pair of electrical contacts movable between open and closed positions, the electrical contacts being mounted in the contact mounting holes and extending along the housing cavity, one of the contacts including a lateral projection adjacent said cavity open end;

an actuator slideably mounted in the housing cavity for moving the contacts between the contacts open and the contacts closed positions, an abutment on said actuator engageable with said contact lateral projection such that the lateral projection and the abutment prevent complete displacement of said actuator from the housing cavity.

8. The switch of claim 7 wherein said contacts are elongated and said housing cavity is defined by a housing peripheral wall and a housing bottom wall, said bottom wall including the mounting holes through which said contacts extend, said contacts having inner portions received in said cavity, said inner lead portions being in opposed relationship, a flexible one of said inner portions being bent and movable toward a fixed one of said inner portions in the manner of a leaf spring and normally being biased into engagement with the fixed inner lead portion.

9. The switch of claim 8 wherein said abutment on said actuator includes a pair of flanges extending outwardly therefrom in spaced-apart relationship and having upper abutment edges, the lateral projection being an integral part of the fixed lead portion, said fixed inner portion being received between said flanges, and said lateral projection on said fixed inner portion comprising a pair of such lateral projections lying in the same plane as the remainder of said fixed inner portion.

10. A miniature switch assembled without the use of mechanical fasteners or bonding comprising:

a housing of synthetic plastic material and having a cavity within a housing peripheral wall and a housing bottom wall, a pair of elongated electrical leads each having an inner lead portion received in said cavity and having cooperable electrical contacts thereon, each said lead extending through a hole in said bottom wall, each said lead having integral lateral enlargements thereon on opposite sides of said bottom wall, each said enlargement having a lateral dimension larger than the lateral dimension of each said hole, a movable actuator in said cavity for making and breaking said contacts, and cooperating means between said actuator and at least one of said inner lead portions for preventing complete displacement of said actuator from said cavity.

11. A miniature switch, comprising:

a housing defining a cavity within a housing peripheral wall and a housing bottom wall;

a fixed lead extending along a surface of said peripheral wall within said cavity, a flexible lead within said cavity in opposed relationship to said fixed lead, cooperative electrical contacts on said leads, said flexible lead being under bending stress to normally engage said contacts, said leads being positioned between opposed surfaces of said cavity; and an actuator closely received between said surfaces and reciprocatable within said cavity relative to said bottom wall for making and breaking said contacts, said actuator including a wiper wall movable between and across said contacts for separating said contacts and wiping same when said actuator is moved to a position for breaking said contacts and a transverse passage through which said flexible lead extends, said actuator having flange means for receiving said fixed lead whereby said flange means, in combination with one of said surfaces and said wiper wall, accommodate said fixed lead during movement of said actuator relative to said housing peripheral wall.

12. The switch of claim 11 wherein said bottom wall has a pair of holes therethrough and each said lead has an outer lead portion extending through one of said holes, and each said lead having enlargements thereon on opposite sides of said bottom wall for preventing movement of said leads through said holes.

13. A miniature switch comprising:

a housing defining a cavity within a housing peripheral wall and a housing bottom wall, a fixed lead extending along a surface of said peripheral wall within said cavity, a flexible lead within said cavity in opposed relationship to said fixed lead, cooperable electrical contacts on said leads, said flexible lead being under bending stress to normally engage said contacts;

an actuator reciprocable within said cavity for making and breaking said contacts, said actuator including a wiper wall movable between and across said contacts for separating said contacts and wiping same when said actuator is moved to a position for breaking said contacts; and, cooperating means between said actuator and said fixed contact for preventing complete displacement of said actuator from said cavity.

* * * * *